US006766124B2

(12) United States Patent
Taguchi et al.

(10) Patent No.: US 6,766,124 B2
(45) Date of Patent: Jul. 20, 2004

(54) IMAGE FORMING APPARATUS AND IMAGE FORMING METHOD HAVING SPEED CONTROL TO IMPROVE THROUGHPUT

(75) Inventors: Keiichi Taguchi, Nagano-ken (JP); Shigeo Fujita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/367,999

(22) Filed: Feb. 19, 2003

(65) Prior Publication Data

US 2003/0170039 A1 Sep. 11, 2003

(30) Foreign Application Priority Data

Feb. 19, 2002 (JP) ..... 2002-041255
Feb. 19, 2002 (JP) ..... 2002-041256

(51) Int. Cl.[7] ..... G03G 15/16
(52) U.S. Cl. ..... 399/66; 399/302; 399/396
(58) Field of Search ..... 399/66, 302, 303, 399/308, 312, 394, 396; 347/116

(56) References Cited

U.S. PATENT DOCUMENTS 5,781,826 A * 7/1998 Inomata ..... 399/53
6,324,358 B1 * 11/2001 Sahara ..... 399/66
6,327,458 B1 * 12/2001 Chapman ..... 399/394
6,519,443 B1 * 2/2003 Coriale et al. ..... 399/388
6,608,991 B2 * 8/2003 Takada ..... 399/394

FOREIGN PATENT DOCUMENTS

EP 1336904 A2 * 8/2003 ..... G03G/15/16
JP 2000221747 A * 8/2000 ..... G03G/15/01
JP 2000330451 A * 11/2000 ..... G03G/21/14

* cited by examiner

*Primary Examiner*—Robert Beatty
(74) *Attorney, Agent, or Firm*—Sughrue Mion, PLLC

(57) ABSTRACT

A CPU 111 drives an intermediate transfer belt at a first speed in a normal mode, but drives the intermediate transfer belt at the first speed in a low speed mode at least until the end of forming a toner image performed by a developer part 20, reduces the speed from the first speed to a second speed after the end of forming the toner image and then maintains the second speed at least until the end of secondary transfer. In the intermediate transfer belt, there are a transfer area, in which primary transfer of a toner image is possible, and a transfer protection area in which primary transfer of a toner image is prohibited and which is provided along a direction of rotation axis. In the low speed mode, the CPU 111 controls image forming so that a toner image will be primarily transferred onto such a portion of the transfer area which is close to the transfer protection area and on the upstream side of the intermediate transfer medium along a direction of rotational driving.

16 Claims, 11 Drawing Sheets

IMAGE FORMING APPARATUS AND IMAGE FORMING METHOD HAVING SPEED CONTROL TO IMPROVE THROUGHPUT

BACKGROUND OF THE INVENTION

1. Field of the Invention

The present invention relates to an image forming technique utilizing electrophotography, such as a printer, a copier machine and a facsimile machine.

2. Description of the Related Art

A conventional image forming apparatus technique utilizing electrophotography is known in which developer means makes toner adhere to an electrostatic latent image which is formed on a photosensitive member by exposure means, a toner image is accordingly formed and then transferred onto a transfer paper, and thus transferred toner image is fixed by fixing means on the transfer paper while the transfer paper is transported. Known in particular as an apparatus which permits to form a color image is an image forming apparatus in which a toner image which is formed on a photosensitive member is primarily transferred onto an intermediate transfer medium and thus transferred transfer image now on the intermediate transfer medium is secondarily transferred onto a transfer paper.

In this image forming apparatus, for the purpose of forming a color image, toner images in a plurality of colors are formed one after another on the photosensitive member while primarily transferring each toner image onto an intermediate transfer medium every time each toner image is formed, a color toner image, which is the toner images in the plurality of colors superimposed one atop the other, is accordingly formed on the intermediate transfer medium, and thus formed color toner image is secondarily transferred onto a transfer paper, whereby a color image is obtained. The image forming apparatus having such a structure is capable of printing in a single color using toner in a particular color among the plurality of colors, typically the black color.

Meanwhile, among image forming apparatuses already in a practical use is an image forming apparatus which permits to use, as a transfer paper, a thicker paper which is thicker than a plain paper, such as a wood-free paper, a postcard, an envelop, a glossy paper and a high definition paper, in addition to a plain paper. However, when fixing means operates while such a thick paper mentioned above is transported at the same speed as that for a plain paper, a sufficient fixing capability is not obtained and the image quality accordingly deteriorates. While it is possible to prevent such a situation by increasing the heat capacity of the fixing means for instance and improving the fixing capability, this solution leads to an increase in size of the apparatus or allows excessive heat to degrade the image quality during fixing on a plain paper. Hence, when a thick paper is used as a transfer paper, such an image forming apparatus slows down a paper transportation speed slower than the speed for a plain paper to thereby extend a fixing time and ensure a sufficiently fixing capability.

An apparatus noting this may be an apparatus which lowers not only a paper transportation speed but also a process speed during forming of an image on a photosensitive member, during primary transfer onto an intermediate transfer medium or during other process. Alternatively, such an apparatus may be an apparatus which slows down only a paper transportation speed but maintains a process speed set to a normal speed. In the former apparatus, since an image forming process is performed at two types of speed, there is a problem that it requires double the labor for calculation of favorable process settings regarding a developing condition, a transfer condition and the like than where the image forming process is performed at only one type of speed and that it therefore takes long time to design the apparatus and confirm operations. In the latter apparatus, however, since one type of speed is used during the image forming process, such a problem will not arise.

Yet, when the latter apparatus is used, it is necessary to sufficiently study the timing of switching from a normal speed to a low speed. While to synchronize the timing of switching to the end of development of a photosensitive member for instance is desirable since this allows to avoid an increase in the number of control parameters and prevent a control program from becoming complex, there is a danger that the throughput of image form could decrease depending on the timing at which development of the photosensitive member ends. For instance, in the case of an apparatus in which an intermediate transfer medium includes a transfer area, which permits primary transfer of a toner image, and a transfer protection area which prohibits primary transfer of a toner image and which is provided along a direction of rotation axis, image form control is performed while referring to one revolution of the intermediate transfer medium, if the switching timing is too early and a driving time for driving the intermediate transfer medium at a low speed consequently becomes long, the throughput of image form will decrease.

Further, in the case of an apparatus which performs image form control using one round of an intermediate transfer medium as a reference, if the switching timing from a normal speed to a low speed is too early, an operation time at the low speed will become long and the throughput of image form will decrease. In a configuration that there are N pieces of toner transfer areas within an intermediate transfer medium, i.e., the first through the N-th (where N is an integer which is equal to or larger than 2) toner transfer areas, a corresponding to predetermined transfer paper size arranged one next to the other along a direction of rotational driving, when there is only one toner image to be transferred, if this toner image is formed inside the first toner transfer area and the apparatus slows down in synchronization to the stop of developing means, it takes long time for a transfer paper to move passing the remaining (N−1) pieces of transfer areas and the throughput of image form will decrease.

In addition, when such an intermediate transfer medium is used, if a toner image transfer end position differs between different transfer paper sizes, the design of operations for forming of the next image becomes complex such as an elapsed time from the end of forming a toner image until an abutting operation during which a cleaning member or the like abuts on the intermediate transfer medium or a clearing operation during which the cleaning member or the like leaves the intermediate transfer medium, and it becomes necessary to execute elaborate debugging to design a control program. This leads to a problem that the number of design steps to design the control program increases and development of the apparatus takes long time.

SUMMARY OF THE INVENTION

A primary object of the present invention is to provide an image forming apparatus and an image forming method which suppress a decrease in throughput of image form in a configuration that there is a low speed mode which uses a low speed as a transfer paper transportation speed.

A different object of the present invention is to provide an image forming apparatus and an image forming method which make it easy to design the timing of forming an image in a configuration that there is a low speed mode which uses a low speed as a transfer paper transportation speed.

The present invention is directed to an image forming apparatus, comprising: developing means which makes toner adhere to an electrostatic latent image formed on a photosensitive member to thereby form a toner image; an intermediate transfer medium onto which the toner image is primarily transferred during rotations of the intermediate transfer medium; secondary transfer means which secondarily transfers the toner image thus primarily transferred and now on the intermediate transfer medium onto a transfer paper; and fixing means which fixes the toner image on the transfer paper while the transfer paper is transported, wherein the image forming apparatus comprises transportation control means which has a normal mode for transporting a transfer paper at a first speed and a low speed mode for transporting a transfer paper at a second speed which is slower than the first speed at least from a secondary transfer position to a fixing end position, the image forming apparatus comprises intermediate transfer medium control means which drives the intermediate transfer medium at the first speed in the normal mode, but drives the intermediate transfer medium at the first speed in the low speed mode at least until the end of forming a toner image performed by the developing means, reduces a driving speed of driving the intermediate transfer medium from first speed to the second speed after the end of forming the toner image and then maintains the second speed at least until the end of secondary transfer, the image forming apparatus comprises image form control means which controls image forming on the photosensitive member so as to change a primary transfer start position on the intermediate transfer medium in accordance with a transfer paper size, the intermediate transfer medium has a transfer area, in which primary transfer of a toner image is possible and which is preset from the downstream side toward the upstream side along a direction of rotational driving, and the image form control means, in the low speed mode, controls the image forming so that a toner image will be primarily transferred onto such a portion of the transfer area which is on the upstream side of the intermediate transfer medium along a direction of rotational driving.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
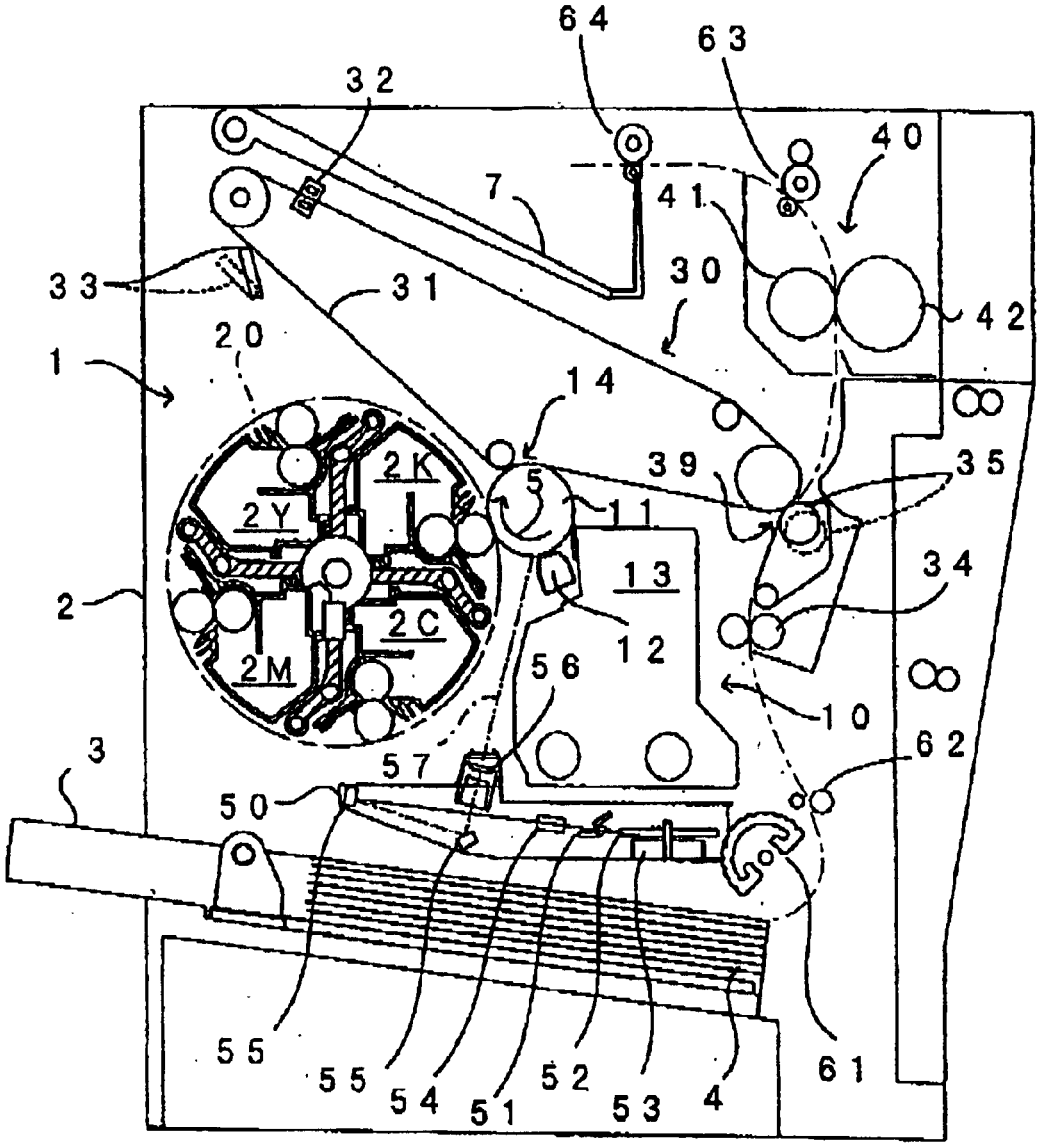
FIG. 1 is a drawing which shows an inner structure of a printer which is a preferred embodiment of an image forming apparatus according to the present invention.
Figure 2:
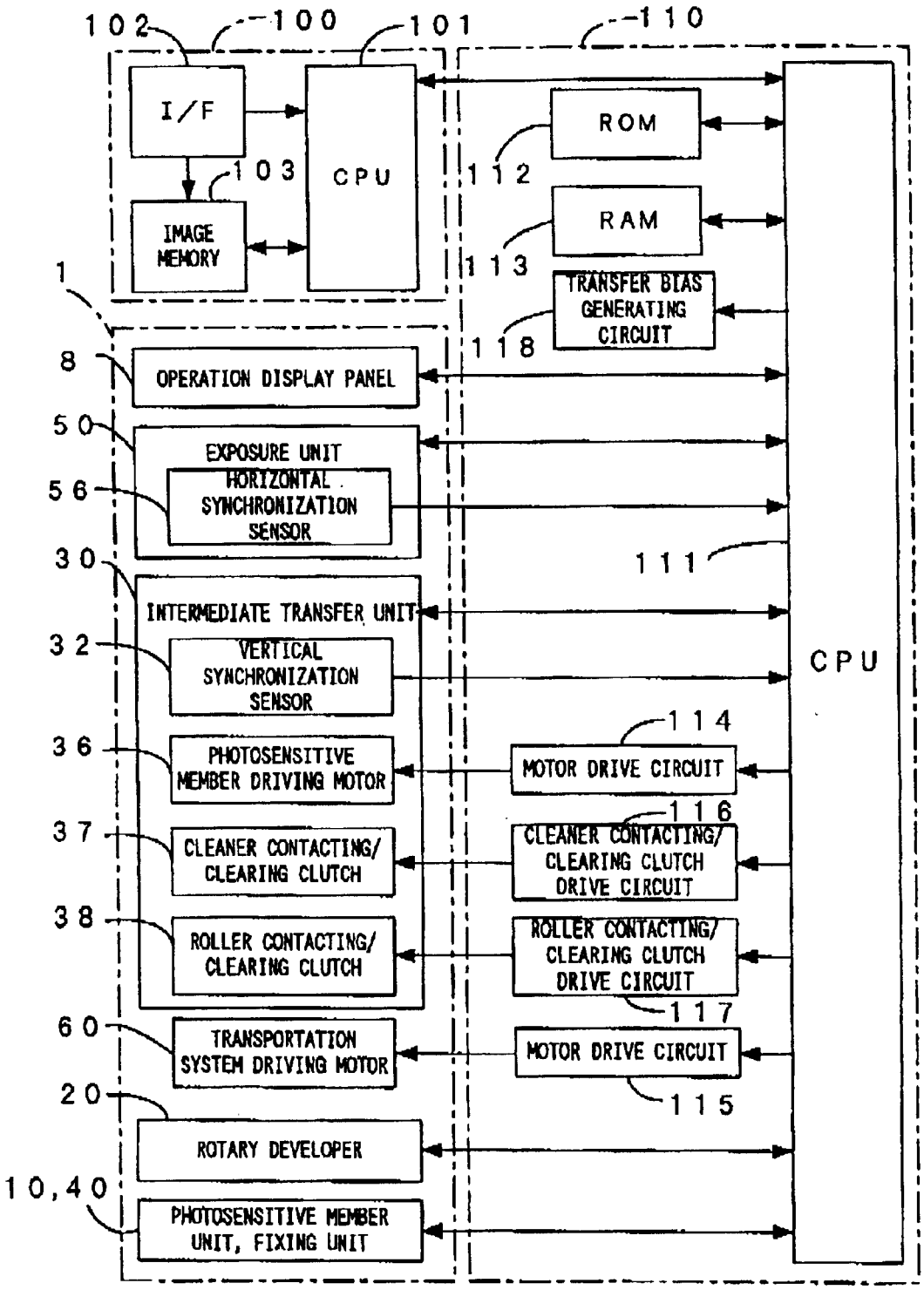
FIG. 2 is a block diagram which shows an electric structure of the printer.
Figure 3A:
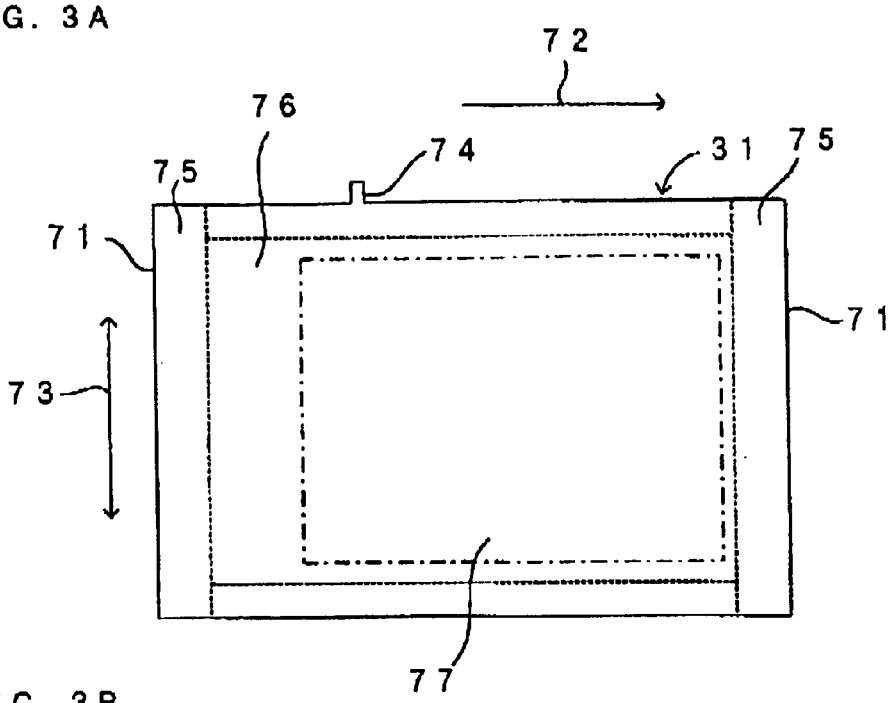
FIGS. 3A and 3B are development views of an intermediate transfer belt.
Figure 3B:
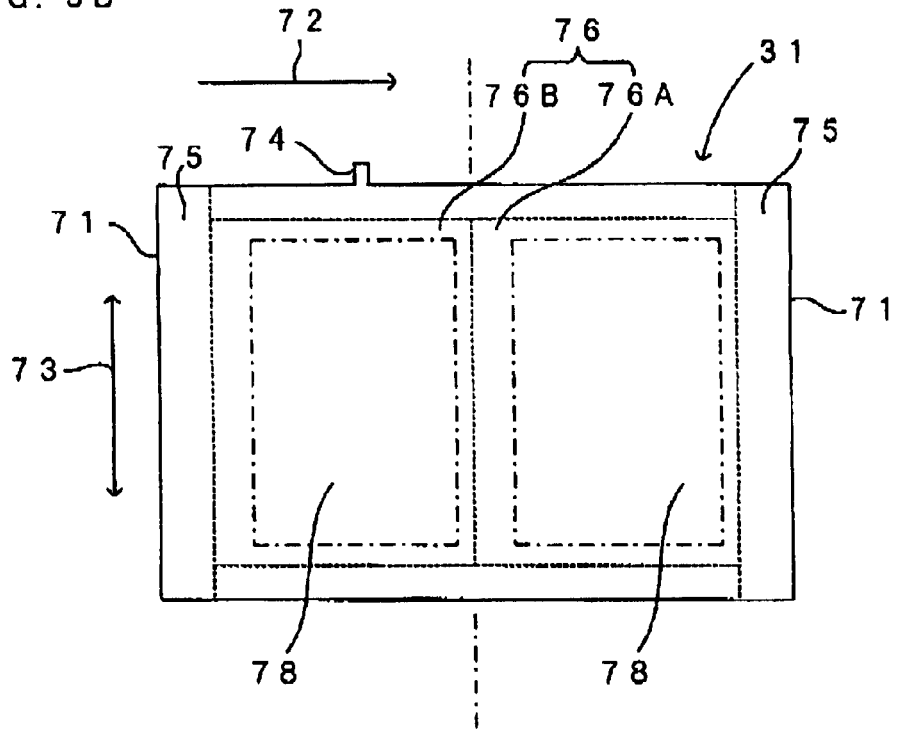

First, referring to FIGS. 1, 2, 3A and 3B, a structure of a printer which is a preferred embodiment of an image forming apparatus according to the present invention will now be described. FIG. 1 is a drawing which shows an inner structure of the printer, FIG. 2 is a block diagram which shows an electric structure of the printer, and FIGS. 3A and 3B are development views of an intermediate transfer belt.

This printer is for superimposing toner in four colors, which are yellow (Y), magenta (M), cyan (C) and black (K), and thereby forming a fall color image, or for forming a monochrome image using only toner in the black color (K) for instance. In this printer, when a print instruction signal containing a video signal is fed to a main controller 100 from an external apparatus such as a host computer, an engine controller 110 controls each portion of an engine part 1 in accordance with a control signal from the main controller 100, and the printer prints out an image corresponding to the video signal on a transfer paper 4 transported from a paper feeding cassette 3 which is disposed in a lower section of a main unit 2.

As the transfer paper 4, in addition to a plain paper, a thick paper thicker than a plain paper may be used such as a wood-free paper, a postcard, an envelop, a glossy paper and a high definition paper (which is a white PET sheet for instance), and a transparency for OHP may also be used. In this printer, a plain paper or a transparency for OHP is transported at a first speed which is a normal speed, while as described later a thick paper is transported at a second speed which is slower than the first speed.

The engine part 1 comprises a photosensitive member unit 10, a rotary developer 20, an intermediate transfer unit 30, a fixing unit 40 and an exposure unit 50. The photosensitive member unit 10 comprises a photosensitive member 11, an electrifier 12 and a cleaner 13. The rotary developer 20 comprises a yellow developer unit 2Y housing yellow toner, a magenta developer unit 2M housing magenta toner, a cyan developer unit 2C housing cyan toner, a black developer unit 2K housing black toner, etc. The intermediate transfer unit 30 comprises an intermediate transfer belt 31, a vertical synchronization sensor 32, a belt cleaner 33, a gate roller pair 34, a secondary transfer roller 35, a photosensitive member driving motor 36, etc. These seven units 10, 2Y, 2M, 2C, 2K, 30 and 40 are formed so that these units can be freely attached to and detached from the main unit 2.

With the seven units 10, 2Y, 2M, 2C, 2K, 30 and 40 described above mounted to the main unit 2, the photosensitive member 11 of the photosensitive member unit 10 is rotated by the photosensitive member driving motor 36 in the direction of an arrow 5. Along the rotating direction 5 of the photosensitive member 11, the electrifier 12, the rotary developer 20 and the cleaner 13 are disposed around the photosensitive member 11.

The electrifier 12 comprises a wire electrode to which a high voltage at a predetermined level is applied. Utilizing corona discharge for instance, the electrifier 12 uniformly electrifies an outer circumferential surface of the photosensitive member 11. The cleaner 13 is disposed on the upstream side to the electrifier 12 in the rotating direction 5 of the photosensitive member 11. The cleaner 13 scrapes off toner which remains on the outer circumferential surface of the photosensitive member 11 after primary transfer of a toner image onto the intermediate transfer belt 31 from the photosensitive member 11, to thereby clean the surface of the photosensitive member 11.

The exposure unit 50 comprises a laser light source 51 which is formed by a semiconductor laser for instance, a polygon mirror 52 which reflects laser light from the laser light source 51, a scanner motor 53 which drives the polygon mirror 52 so that the polygon mirror 52 rotates at a high speed, a lens part 54 which converges the laser light reflected by the polygon mirror 52, a plurality of reflection mirrors 55, a horizontal synchronization sensor 56, etc. Leaving the lens part 54 and the reflection mirrors 55 after reflected by the polygon mirror 52, laser light 57 scans the surface of the photosensitive member 11 in a main scanning direction (a direction which is perpendicular to the plane of FIG. 1), whereby an electrostatic latent image corresponding to the video signal is formed on the surface of the photosensitive member 11. At this stage, the horizontal synchronization sensor 56 provides a synchronizing signal which is in the main scanning direction, i.e., a horizontal synchronizing signal. The exposure unit 50 functions as exposure means.

The rotary developer 20 is for making the toner in the respective colors adhere to the electrostatic latent image to thereby develop the electrostatic latent image. The yellow developer unit 2Y, the magenta developer unit 2M, the cyan developer unit 2C and the black developer unit 2K of the rotary developer 20 are disposed for free rotations about an axis. These developer units 2Y, 2M, 2C and 2K are movable to a plurality of predetermined positions, and are selectively located at an abutting position to the photosensitive member 11 and a cleared-off position from the photosensitive member 11. When a developing bias is applied which is a direct current component as it is alone or a direct current component on which an alternating current component is superimposed, from the developer unit which is at the abutting position relative to the photosensitive member 11, the toner in the corresponding color adheres to the surface of the photosensitive member 11. The rotary developer 20 functions as developing means.

The intermediate transfer belt 31 of the intermediate transfer unit 30 stretches around a plurality of rollers and abuts on the photosensitive member 11 in the primary transfer part 14, and is driven by the photosensitive member driving motor 36 and accordingly rotates together with the photosensitive member 11. As shown FIGS. 3A and 3B, the intermediate transfer belt 31 is formed by an endless belt which is obtained by joining an approximately rectangular sheet at a splice 71. In FIGS. 3A and 3B, an arrow 72 denotes a direction of rotational driving, while an arrow 73 denotes a direction of rotation axis. On one edge side along the direction of rotation axis 73 (on the top side in FIGS. 3A and 3B), a projection 74 is disposed to the intermediate transfer belt 31.

Further, the intermediate transfer belt 31 contains a transfer protection area 75 and a transfer area 76. The transfer protection area 75 is provided across one edge and the other edge along the direction of rotation axis 73 and within a predetermined range which stretches on the both sides to the splice 71. The transfer area 76 is an area other than the transfer protection area 75, and expands in a rectangular area except for a one edge portion and other edge portion along the direction of rotation axis 73. The transfer area 76 has a larger size than that of an A3 paper as it is placed with the longer sides aligned along the direction of rotational driving 72, As shown in FIG. 3A, it is therefore possible to transfer an image 77 whose size is that of an A3 paper as it is placed with the longer sides aligned along the direction of rotational driving 72. Further, as shown in FIG. 3B, the transfer area 76 can be split into two sub areas 76A and 76B. It is therefore possible to transfer two images 78 each having the size of an A4 paper with the shorter sides aligned along the direction of rotational driving 72, while the intermediate transfer belt 31 rotates one round.

The vertical synchronization sensor 32 is formed by a photo-interrupter which comprises a light emitter and a light receiver which are disposed so as to face each other, for instance. The vertical synchronization sensor 32 is disposed on the one edge side of the rotating intermediate transfer belt 31 along the direction of rotation axis 73 and detects a passage of the projection 74. The resulting detection signal is used as a vertical synchronizing signal which the engine controller 110 refers to when controlling forming an image. The belt cleaner 33 is disposed so that a cleaner contacting/clearing clutch 37 can switch the belt cleaner 33 between an abutting state (denoted by the solid line in FIG. 1) abutting on the intermediate transfer belt 31 and a cleared-off state (denoted by the dotted line in FIG. 1). In the abutting state, the belt cleaner 33 scrapes off toner which remains on the intermediate transfer belt 31. When a gate clutch is turned on, the drive force of a transportation system driving motor 60 is transmitted to the gate roller pair 34 and the gate roller pair 34 accordingly rotates.

A contacting/clearing clutch for secondary transfer roller 38 switches the secondary transfer roller 35 between an abutting state (denoted by the solid line in FIG. 1) abutting on the intermediate transfer belt 31 and a cleared-off state (denoted by the dotted line in FIG. 1). When applied with a predetermined secondary transfer bias in the abutting state abutting on the intermediate transfer belt 31, the secondary transfer roller 35 secondarily transfers a toner image currently on the intermediate transfer belt 31 onto the transfer paper 4 while the transfer paper 4 is transported. This abutting position is located in a secondary transfer part 39.

The intermediate transfer belt 31 corresponds to an intermediate transfer medium, while the belt cleaner 33 and the secondary transfer roller 35 correspond to an abutting member. The secondary transfer roller 35 constitutes secondary transfer means.

The fixing unit 40 comprises a heating roller 41 and a pressure roller 42, and fixes a toner image on the transfer paper 4 by a heating roller fixing method while transporting the transfer paper 4 so that the toner image currently on the transfer paper 4 will be fixed on the transfer paper 4. The fixing unit 40 therefore functions as fixing means.

A crescent-shaped pick-up roller 61 and a feed roller pair 62 are disposed toward above from the front edge of the paper feeding cassette 3 (the right-most edge in FIG. 1). Further, on the opposite side to the gate roller pair 34, the secondary transfer roller 35 and the fixing unit 40, a transportation roller pair 63 and a discharging roller pair 64 are disposed, whereby a transportation path for the transfer paper 4 (denoted at the chain line in FIG. 1) is formed.

The pick-up roller 61 is driven by a pick-up solenoid. The feed roller pair 62, the gate roller pair 34, the secondary transfer roller 35, the heating roller 41 of the fixing unit 40, the transportation roller pair 63 and the discharging roller pair 64 are each linked to the same transportation system driving motor 60 via a drive force transmission mechanism. When a feed clutch is turned on, the drive force of the transportation system driving motor 60 is transmitted to the feed roller pair 62, and the feed roller pair 62 accordingly rotates. The rotation speed of the transportation system driving motor 60 can be switched between two types of transportation speeds for transportation of the transfer papers 4, that is, between a first speed S1 for transporting a transfer paper at a normal speed and a second speed S2 (<S1) for transporting a thick paper.

The feed roller pair 62, the gate roller pair 34, the transportation roller pair 63 and the discharging roller pair 64 constitute transporting means for the transfer papers 4.

In FIG. 2, the main controller 100 comprises a CPU 101, an interface 102 which transfers a control signal with the external apparatus such as a host computer, and an image memory 103 which stores the video signal received through the interface 102. Upon receipt of the print instruction signal containing the video signal from the external apparatus via the interface 102, the CPU 101 converts the same into job data which are in a format appropriate to provide the engine part 1 with an instruction for operation, and sends the data to the engine controller 110.

The engine controller 110 comprises the CPU 111, a ROM 112, a RAM 113, etc. The ROM 112 stores the control program of the CPU 111, etc. The RAM 113 temporarily stores control data for the engine part 1, a result of computation performed by the CPU 111, etc.

As input signals from the engine part 1, the CPU 111 receives the vertical synchronizing signal Vsync from the vertical synchronization sensor 32, the horizontal synchronizing signal Hsync from the horizontal synchronization sensor 56, and the like. Based on these input signals and the control program, the CPU 111 controls operations of the respective portions of the engine part 1.

That is, the CPU 111 sends a control signal to a motor drive circuit 114 which drives the photosensitive member driving motor 36, synchronizes the photosensitive member 11 and the intermediate transfer belt 31 to each other, and drives these into rotations. Further, the CPU 111 sends a control signal to a motor drive circuit 115 which drives the transportation system driving motor 60, and controls feeding of the transfer paper 4 from the paper feeding cassette 3.

At this stage, when a plain paper or a transparency for OHP is to be transported as the transfer paper 4, the transfer paper 4 is transported at the first speed S1 which is set in advance and the CPU 111 controls so that the peripheral velocities of the photosensitive member 11 and the intermediate transfer belt 31 will match with the first speed S1. On the contrary, when the transfer paper 4 is the thick paper described above, the thick paper (the transfer paper) 4 is transported at the second speed S2 which is set in advance (<S1). Until the end of development of the photosensitive member 11 (until the end of development in the fourth color for a color image), the photosensitive member 11 and the intermediate transfer belt 31 are controlled so that the peripheral velocities of the photosensitive member 11 and the intermediate transfer belt 31 will match with the first speed S1, deceleration is started in synchronization to the end of the development, and the photosensitive member 11 and the intermediate transfer belt 31 are thereafter controlled so that the peripheral velocities of the photosensitive member 11 and the intermediate transfer belt 31 will match with the second speed S2. This increases the period of time the transfer paper 4 needs to move through the fixing unit 40, and hence, compensates for a shortage in fixing capacity which arises since the transfer paper 4 is a thick paper.

In addition, the CPU 111 sends a control signal to a contacting/clearing clutch drive circuit 116 which drives the cleaner contacting/clearing clutch 37, and controls clearing off of the belt cleaner 33 from the intermediate transfer belt 31 and abutting of the belt cleaner 33 on the intermediate transfer belt 31. Still further, the CPU 111 sends a control signal to a roller contacting/clearing clutch drive circuit 117 which drives the contacting/clearing clutch for secondary transfer roller 38, and controls clearing off of the secondary transfer roller 35 from the intermediate transfer belt 31 and abutting of the secondary transfer roller 35 on the intermediate transfer belt 31.

Still further, the CPU 111 sends a control signal to a transfer bias generating circuit 118 which generates the transfer biases, to thereby control application of the primary transfer bias upon the intermediate transfer belt 31 and application of the secondary transfer bias upon the secondary transfer roller 35.

The CPU 111 receives the content of an operation made on an operating key of an operation display panel 8 which is disposed on the surface of the main unit 2 for instance, and controls the content of what is displayed on a display part.

When only one image is to be formed in a size which can be transferred two images to the intermediate transfer belt 31 while the intermediate transfer belt 31 rotates one round and the transfer paper 4 is the thick paper described above (for example, one wishes to form, on the thick paper, one image whose size is the A4 size with the shorter sides aligned along the direction of rotational driving 72), the CPU 111 controls forming an electrostatic latent image on the photosensitive member 11 so that a toner image will be primarily transferred onto the sub area 76B which is on the upstream side in the transfer area 76 along the direction of rotational driving 72. An operation under this control will be described later.

The CPU 111 thus constitutes transportation control means, intermediate transfer medium control means, image form control means and abutting means control means.

Figure 4:
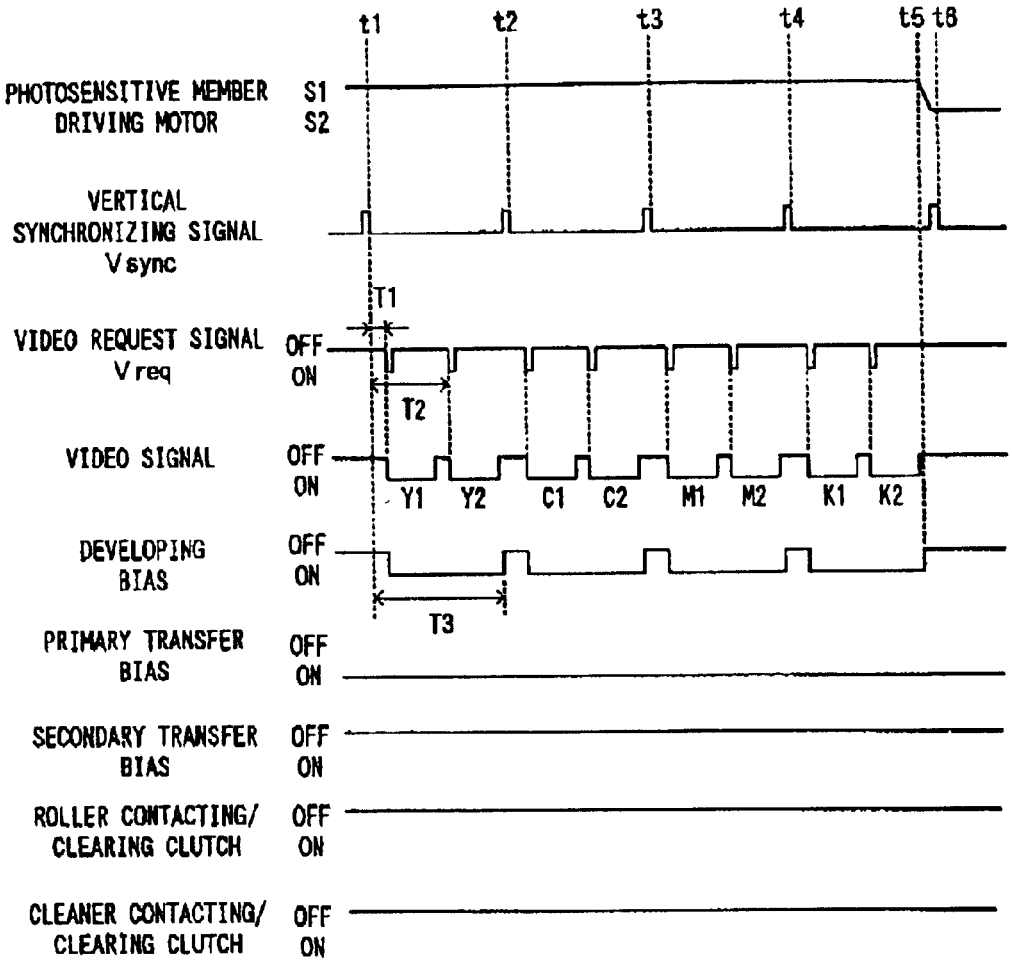
FIGS. 4 and 5 are timing charts for describing operations of the respective portions of an engine part at sequential time (time 1 to time 14), FIG. 4 showing the operations from the time t1 to the time t6, and FIG. 5 showing the operations from the time t4 to the time t14.
Figure 5:
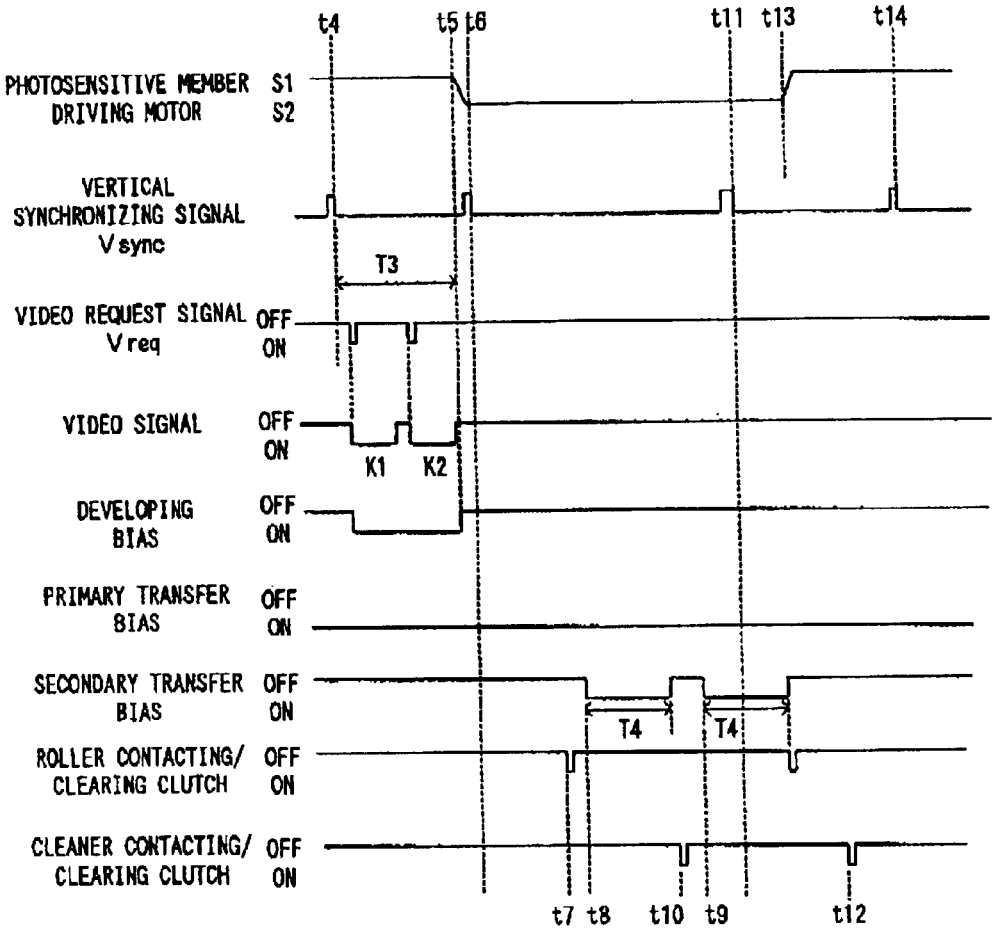

Referring to FIGS. 4 and 5, a description will now be given on an operation for a situation that one wishes to form two images of a size which can be transferred two images to the intermediate transfer belt 31 while the intermediate transfer belt 31 rotates one round and the transfer paper 4 is the thick paper described above. FIGS. 4 and 5 are timing charts for describing operations of the respective portions of the engine part 1.

When a print instruction signal containing a video signal is fed to the main controller 100 from the external apparatus such as a host computer, the engine controller 110 controls an operation of each portion of the engine part 1 in accordance with a control signal from the main controller 100. At this stage, when the size of the transfer papers 4 stacked up in the paper feeding cassette 3 fails to match with the size designated by the print instruction signal, the operation display panel 8 shows a message which encourages to replace the paper feeding cassette. Although FIG. 1 shows the printer as a printer which comprises one paper feeding cassette 3, this is not limiting. Instead, the printer may comprise a plurality of paper feeding cassettes.

When the size of the transfer papers 4 stacked up in the paper feeding cassette 3 matches with the size designated by the print instruction signal, by means of the laser light 57 emitted from the exposure unit 50, an electrostatic latent image corresponding to the video signal described above is created on the surface of the-photosensitive member 11 which is uniformly electrified by the electrifier 12. The rotary developer 20 develops the electrostatic latent image, thereby forming a toner image. In the primary transfer part 14, the toner image thus formed on the photosensitive member 11 is primarily transferred onto the intermediate transfer belt 31.

That is, in FIG. 4, the photosensitive member driving motor 36 rotates the intermediate transfer belt 31 at the first speed S1, and the vertical synchronizing signal Vsync is outputted at the time t1, t2, t3 and t4. After a predetermined period T1 since the falling edges of the vertical synchronizing signal Vsync, the video request signal Vreq for the first image is outputted. In synchronization to falling of this video request signal Vreq, forming an electrostatic latent image corresponding to the video signal representing the first image is started, concurrently with which the developing bias is turned on. Meanwhile, after a predetermined period T2 (>T1) since the falling edges of the vertical synchronizing signal Vsync, the video request signal Vreq for the second image is outputted. In synchronization to falling of this video request signal Vreq, forming an electrostatic latent image corresponding to the video signal representing the second image is started.

The developing units of the rotary developer 20 switch over with each other at the time t1, t2, t3 and t4, whereby toner images in the respective colors are formed on the photosensitive member It and primarily transferred one after another onto the intermediate transfer belt 31. Since the secondary transfer roller 35 stays cleared off from the intermediate transfer belt 31 during this, the toner images in the respective colors are superimposed one atop the other on the intermediate transfer belt 31. The developing bias is turned off after a predetermined period of time which is determined in advance depending on the size of the transfer papers since the falling edges of the vertical synchronizing signal Vsync at the time t1, t2, t3 and t4.

As a result, a color image which is toner images Y1, C1, M1 and K1 as they are superimposed one atop the other is primarily transferred onto the sub area 76A which is on the downstream side in the transfer area 76 of the intermediate transfer belt 31 along the direction of rotational driving 72, and a color image which is toner images Y2, C2, M2 and K2 as they are superimposed one atop the other is primarily transferred onto the sub area 76B which is on the upstream side in the transfer area 76 of the intermediate transfer belt 31 along the direction of rotational driving 72.

Following this, in FIG. 5, upon development of the last electrostatic latent image (forming the toner image K2), in synchronization to turning off of the developing bias at the time t5 which is after the predetermined period T3, which corresponds to the transfer paper size, from the time t4 (a falling edge of the vertical synchronizing signal Vsync), deceleration of the photosensitive member driving motor 36 is started to thereby drive at a peripheral velocity which is equal to the second speed S2.

On the other hand, the top-most transfer paper 4 among the bundle of transfer papers housed in the paper feeding cassette 3 is taken out by the pick-up roller 61, transported by the feed roller pair 62 at the speed S2, and nipped by the gate roller pair 34. The gate clutch turns on in synchronization to a toner image on the intermediate transfer belt 31, and the transfer paper 4 is transported toward the secondary transfer part 37 from the gate roller pair 34 at the speed S2.

The contacting/clearing clutch for secondary transfer roller 38 turns on at the time t7 which is after a predetermined period since the time t6, and the secondary transfer roller 35 accordingly abuts on the intermediate transfer belt 31. Following this, at the time t8 which is after a predetermined period from the time t6, application of the secondary transfer bias from the transfer bias generating circuit 118 upon the secondary transfer roller 35 is activated.

This realizes transfer onto the first transfer paper 4 of the color image which is toner images Y1, C1, M1 and K1 as they are superimposed one atop the other and which was primarily transferred onto the sub area 76A which is on the downstream side in the transfer area 76 of the intermediate transfer belt 31 along the direction of rotational driving 72.

The gate clutch is temporarily turned off after discharging of the first transfer paper 4. A period T4 during which the secondary transfer bias is applied is set in advance in accordance with the size of the transfer papers 4. At this stage, the next transfer paper 4 is taken out by the pick-up roller 61, transported by the feed roller pair 62 at the speed S2, and nipped by the gate roller pair 34.

After turning off of the gate clutch and application of the secondary transfer bias, the gate clutch turns on in synchronization to the next toner image and the next transfer paper 4 is transported, and application of the secondary transfer bias turns on at the time t9 which is after a predetermined period since the time t6. When the preset period T4 during which the secondary transfer bias is applied elapses, application of the secondary transfer bias turns off, and the contacting/clearing clutch for secondary transfer roller 38 turns on and the secondary transfer roller 35 leaves the intermediate transfer belt 31.

This realizes transfer onto the second transfer paper 4 of the color image which is toner images Y2, C2, M2 and K2 as they are superimposed one atop the other and which was primarily transferred onto the sub area 76B which is on the upstream side in the transfer area 76 of the intermediate transfer belt 31 along the direction of rotational driving 72.

In the fixing unit 40, the toner image is fixed on the transfer paper 4 during transportation of the transfer paper 4. At this stage, since the transfer paper 4 is transported at the speed S2 which is slower than the speed S1, a sufficient fixing time is ensured. The transfer paper 4 is further transported by the transportation roller pair 63 and discharged by the discharging roller pair 64 into a discharging part 7 which is disposed to an upper section of the main unit 2.

The cleaner contacting/clearing clutch 37 turns on at the time t10 which is after a predetermined period since the time t6, and cleaning of toner remaining on the intermediate transfer belt 31 is started. The predetermined period is set in advance so that the abutting position of the belt cleaner 33 will be in the process of moving through the transfer protection area 75 and immediately after passing the sub area 76B of the transfer area 76 onto which the color image which is toner images Y2, C2, M2 and K2 as they are superimposed one atop the other was transferred. At the time t12 after a predetermined period since the time t11 which is the next falling edge of the vertical synchronizing signal Vsync, the cleaner contacting/clearing clutch 37 turns on again and the belt cleaner 33 moves cleared off from the intermediate transfer belt 31.

In this embodiment, the next print instruction signal is fed via the main controller 100 from the external apparatus by the time t11, and the photosensitive member driving motor 36 is accelerated and returns to the first speed S1 from the second speed S2 at the time t13 which is after a predetermined period from the time t11. Hence, considering this change in speed, the timing of clearing off of the belt cleaner 33 is determined in advance so as to coincide with the timing at which the transfer protection area 75 after rotating one round moves passed the abutting position of the belt cleaner 33. The next image forming is then controlled, using as a reference the time t14 at which the next vertical synchronizing signal Vsync falls.

In this manner, during the operation described with FIGS. 4 and 5, a sufficient fixing time is ensured since the transfer paper 4 is transported at the speed S2 which is slower than the speed S1, and therefore it is possible to fix in an excellent manner on the transfer paper 4 which is a thick paper.

Further, since deceleration down to the speed S2 is started in synchronization to the suspension of application of the developing bias, it is not necessary to newly establish a control parameter for the start of deceleration and it is possible to prevent the design of the control program from becoming complex.

In addition, since the secondary transfer roller 35 abuts on or moves cleared off the intermediate transfer belt 31 when primary transfer is not ongoing, it is possible to prevent a misregistration attributed to abutting or clearing off during primary transfer of a color image. Further, since the belt cleaner 33 abuts on or moves cleared off the intermediate transfer belt 31 when primary transfer is not ongoing, it is possible to prevent a misregistration attributed to abutting or clearing off during primary transfer of a color image.

Figure 6:
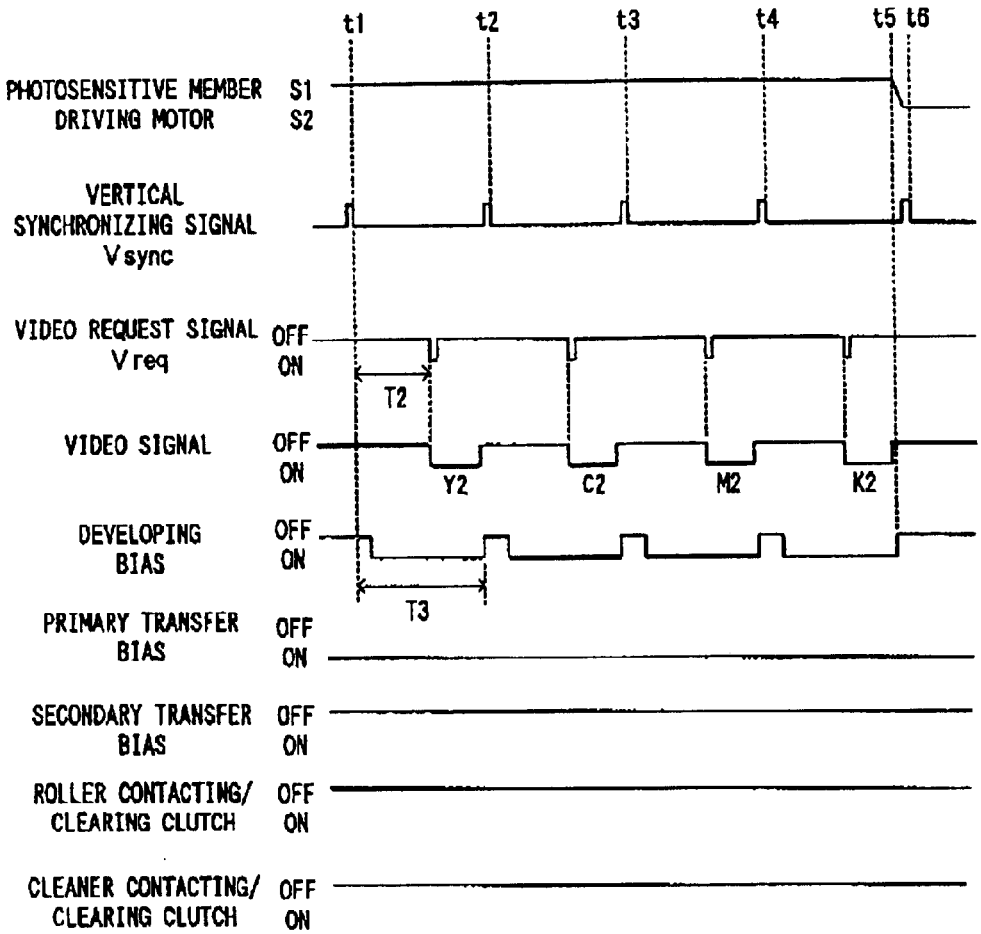
FIGS. 6 and 7 are timing charts for describing operations of the respective portions of the engine part at sequential time (time 1 to time 14), FIG. 6 showing the operations from the time t1 to the time t6, and FIG. 7 showing the operations from the time t4 to the time t14.
Figure 7:
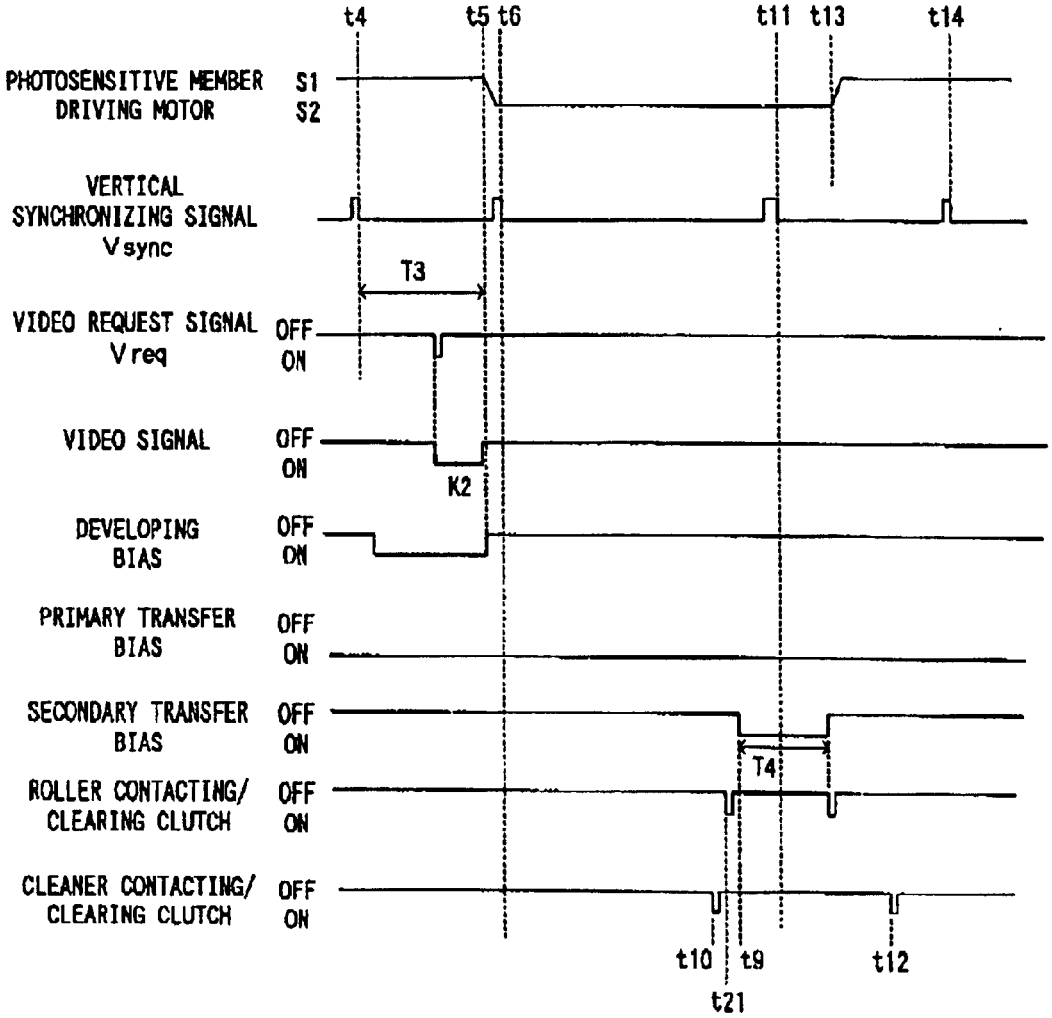
Figure 8:
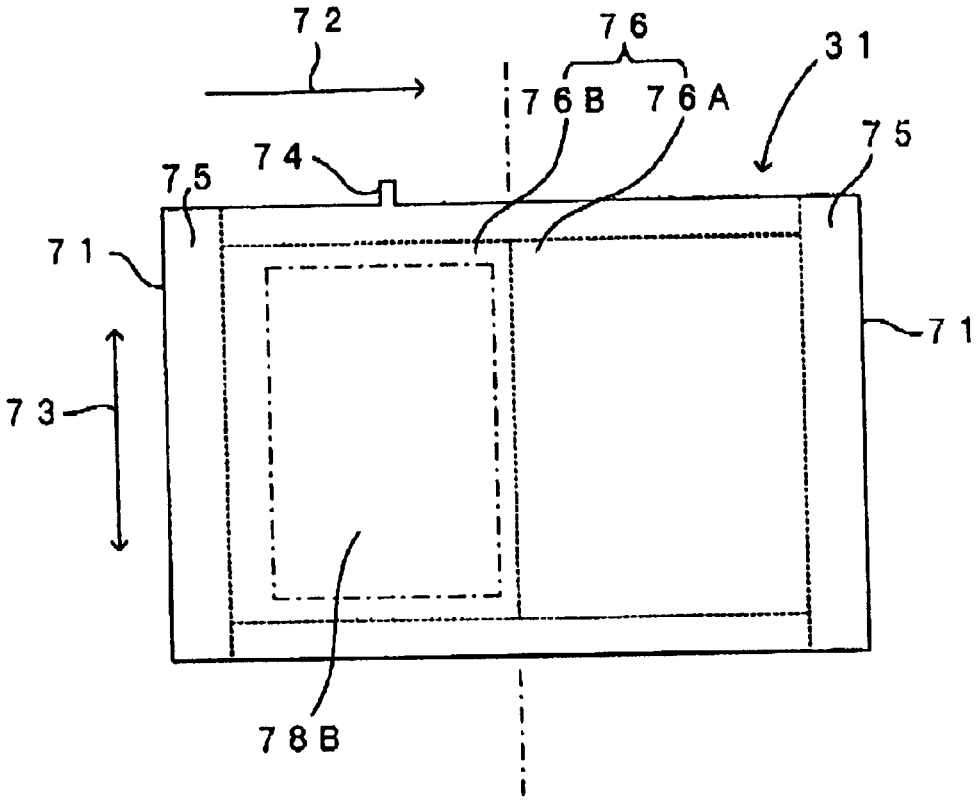
FIG. 8 is a drawing for describing an image transfer position relative to the intermediate transfer belt.

Referring to FIGS. 6 through 8, a description will now be given on an operation for a situation that one wishes to form only one image of a size which can be transferred two images to the intermediate transfer belt 31 while the intermediate transfer belt 31 rotates one round (the same size as that shown in FIGS. 4 and 5) and the transfer paper 4 is the thick paper described above. FIGS. 6 and 7 are timing charts for describing operations of the respective portions of the engine part 1, and FIG. 8 is a drawing for describing an image transfer position relative to the intermediate transfer belt 31. In FIGS. 6 and 7, the same timing as that of FIGS. 4 and 5 is denoted at the same reference symbol.

In FIG. 6, as in FIG. 4, the photosensitive member driving motor 36 is driven at the first speed S1 and the intermediate transfer belt 31 accordingly rotates, the vertical synchronizing signal Vsync is outputted at the time t1, t2, t3 and t4. During this operation, the video request signal Vreq is outputted after the predetermined period T2 from falling edge of the vertical synchronizing signal Vsync. In synchronization to falling of this video request signal Vreq, forming an electrostatic latent image corresponding to the video signal is started and the developing bias is turned on. The developing units of the rotary developer 20 switch over with each other at the time t1, t2, t3 and t4, whereby toner images Y2, C2, M2 and K2 in the respective colors are formed on the photosensitive member 11 and primarily transferred onto the intermediate transfer belt 31. Since the secondary transfer roller 35 stays cleared off from the intermediate transfer belt 31 during this, the toner images in the respective colors are superimposed one atop the other on the intermediate transfer belt 31. The developing bias is turned off after the predetermined period T3, which is determined in advance depending on the size of the transfer papers, from the falling edges of the vertical synchronizing signal Vsync.

As a result, a color image which is toner images Y2, C2, M2 and K2 as they are superimposed one atop the other is primarily transferred onto the sub area 76B which is on the upstream side in the transfer area 76 of the intermediate transfer belt 31 along the direction of rotational driving 72.

In FIG. 7, as in FIG. 5, upon development of the last electrostatic latent image (forming the toner image K2), the developing bias is turned off at the time t5 which is after the predetermined period T3 corresponding to the transfer paper size from the time t4 (a falling edge of the vertical synchronizing signal Vsync). In synchronization to turning off of the developing bias, deceleration of the photosensitive member driving motor 36 is started to thereby drive at a peripheral velocity which is equal to the second speed S2.

On the other hand, the transfer paper 4 is transported from the paper feeding cassette 3 at similar timing to that for the second one shown in FIG. 5. The gate clutch turns on in synchronization to the toner image on the intermediate transfer belt 31 and the transfer paper 4 is transported at the second speed S2 from the gate roller pair 34 toward a secondary transfer part 39.

At the time t21 which is after a predetermined period since the time t6, the contacting/clearing clutch for secondary transfer roller 38 turns on and the secondary transfer roller 35 abuts on the intermediate transfer belt 31. At the time t9 which is after a predetermined period since the time t6, application of the secondary transfer bias from the transfer bias generating circuit 118 upon the secondary transfer roller 35 is activated. When the preset period T4 during which the secondary transfer bias is applied elapses, application of the secondary transfer bias turns off, and the contacting/clearing clutch for secondary transfer roller 38 turns on and the secondary transfer roller 35 leaves the intermediate transfer belt 31.

This realizes transfer onto the transfer paper 4 of a color image 78B which is the toner images Y2, C2, M2 and K2 as they are superimposed one atop the other and which was primarily transferred onto the sub area 76B which is on the upstream side in the transfer area 76 of the intermediate transfer belt 31 along the direction of rotational driving 72, as shown in FIG. 8.

Meanwhile, as in FIG. 5, the cleaner contacting/clearing clutch 37 turns on at the time t10, and cleaning of toner remaining on the intermediate transfer belt 31 is started. At the time t12, the cleaner contacting/clearing clutch 37 turns on again and the belt cleaner 33 moves cleared off from the intermediate transfer belt 31. The next image forming is then controlled, using as a reference the time t14 at which the next vertical synchronizing signal Vsync falls.

In this manner, during the operation described with FIGS. 6 and 7, as in the operation shown in FIGS. 4 and 5, since deceleration down to the speed S2 is started in synchronization to the suspension of application of the developing bias, it is not necessary to newly establish a control parameter for the start of deceleration and it is possible to prevent the design of the control program from becoming complex.

In the event that a toner is transferred onto the sub area 76A which is on the downstream side in the transfer area 76 of the intermediate transfer belt 31 along the direction of rotational driving 72 and deceleration is in synchronization to the suspension of application of the developing bias, the driving time at the second speed S2 for an amount corresponding to the size of the sub area 76B and the throughput decreases. However, during the operation shown in FIGS. 6 and 7, a toner is transferred onto the sub area 76B which is on the upstream side in the transfer area 76 of the intermediate transfer belt 31 along the direction of rotational driving 72, it is possible to prevent the throughput from dropping.

Further, during the operation shown in FIGS. 6 and 7, since the belt cleaner 33 and the secondary transfer roller 35 abut on or move cleared off the intermediate transfer belt 31 when primary transfer of a toner image onto the intermediate transfer belt 31 from the photosensitive member 11 is not ongoing, it is possible to prevent a misregistration attributed to abutting or clearing off during primary transfer of a color image.

Figure 9:
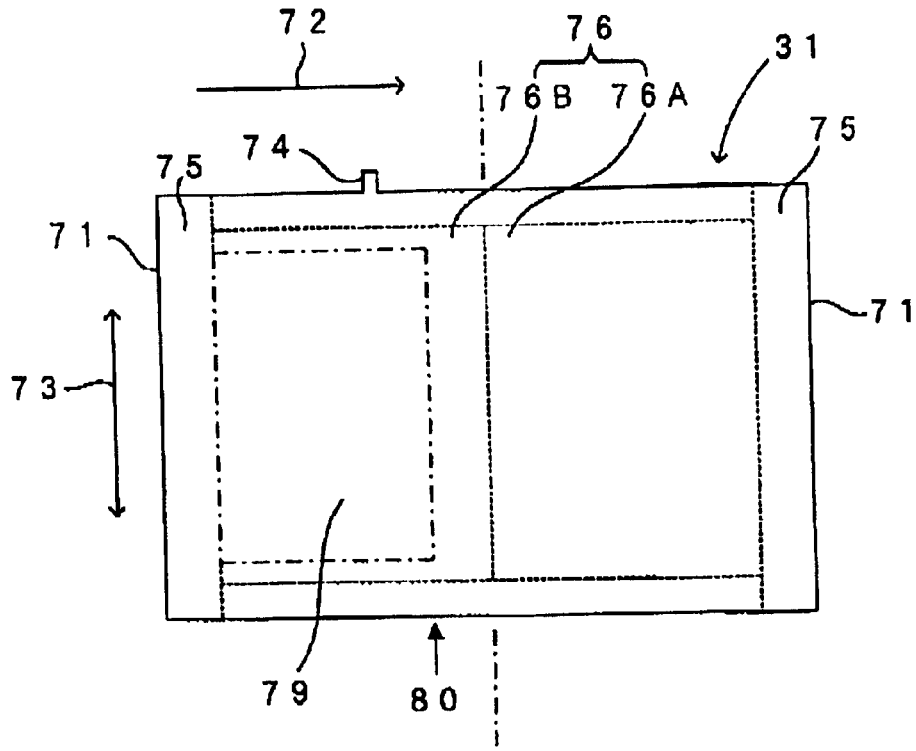
FIG. 9 is a drawing for describing the image transfer position relative to the intermediate transfer belt during different operations.
Figure 10:
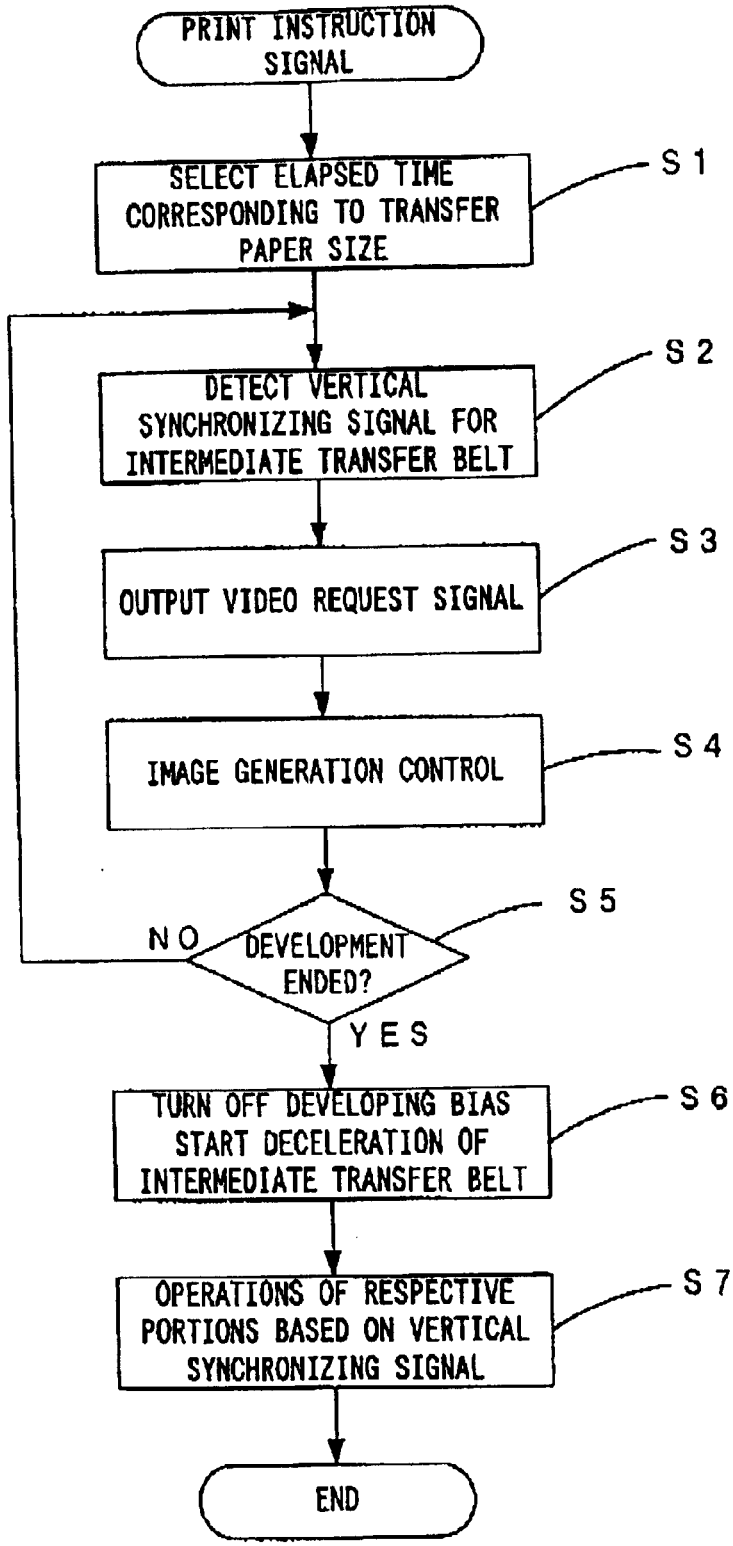
FIG. 10 is a flow chart showing the sequence of operations.

Referring to FIGS. 9 and 10, different operations of the printer will now be described. FIG. 9 is a drawing for describing the image transfer position relative to the intermediate transfer belt 31, and FIG. 10 is a flow chart showing the sequence of operations.

During the operation described with FIGS. 6 through 8, as for each one of different transfer paper sizes, a toner image transfer start position on the downstream side is set such that the rear edge (the rear edge on the upstream side) of a toner image on the intermediate transfer belt 31 along the direction of rotational driving 72 will match with the rear edge on the upstream side of the transfer area 76. For instance, as shown in FIG. 9, a toner image transfer start position 80 is set such that the rear edge of a toner image 79 having the A4 size will match with the rear edge on the upstream side of the transfer area 76.

Hence, an elapsed time until outputting of the video request signal Vreq since the vertical synchronizing signal Vsync is determined in advance for each one of the transfer paper sizes. In other words, the elapsed time until outputting of the video request signal Vreq since the vertical synchronizing signal Vsync is determined in advance so that transfer of a toner image will start at the toner image transfer start position 80 for instance. Thus determined elapsed time is stored as the control program in the ROM 112.

The CPU 111 controls forming an electrostatic latent image on the photosensitive member 11 so that the rear edge of a toner image will match with the upstream side edge of the transfer area 76 along the direction of rotational driving 72.

When the print instruction signal is fed via the main controller 100 from the external apparatus such as a host computer, the routine shown in FIG. 10 is started. First, the transfer paper size contained in job data sent to the engine controller 110 from the main controller 100 is extracted, a corresponding elapsed time is selected, and driving of the engine part 1 is started (Step S1).

Next, upon detection of the vertical synchronization sensor 32 by the vertical synchronizing signal Vsync (Step S2), the elapsed time is counted from the falling edge of the vertical synchronizing signal Vsync. When the count reaches the elapsed time selected at the step S1, the video request signal Vreq is outputted (Step S3).

Based on the video request signal Vreq, image forming on the photosensitive member 11 is controlled (Step S4), and whether development has completed is judged (Step S5).

When an image demanded by the print instruction signal is developed as a color image in yellow on the photosensitive member 11 (NO at Step 5) for instance, the sequence returns to the step S2 and the steps above are repeated, whereby toner images in cyan, magenta and black are formed one after another and primarily transferred onto the intermediate transfer belt 31 one atop the other and a color image is accordingly formed.

When development finishes, that is, when development in black finishes for a color image, or for a single color image, when development in that color finishes (YES at Step S5), the developing bias is turned off, controlling for suspension of the rotary developer 20 is initiated, and deceleration of the photosensitive member driving motor 36 down to the speed S2 is started in synchronization to this (Step S6).

As in FIG. 7, this is followed by operations such as driving of the secondary transfer roller 35, transportation of the transfer paper 4 and activation of the belt cleaner 33, based on the vertical synchronizing signal Vsync (Step S7), and the sequence ends if there is not a next print instruction signal provided.

In this manner, during the operation described with FIGS. 9 and 10, the rear edge (the rear edge on the upstream side) of a toner image along the direction of rotational driving 72 is matched with the upstream side edge of the transfer area 76, the operations to start next image forming, such as the operation of starting deceleration of the intermediate transfer belt 31 in synchronization to turning off of the developing bias, the operation of contacting and clearing the secondary transfer roller 35 and the operation of contacting and clearing the belt cleaner 33, are timed to be always the same. Hence, control parameter settings will not become complex and the design of the control program will not become complex.

Meanwhile, in general, noting that a load upon the intermediate transfer belt 31 may change or the intermediate transfer belt 31 may stretch or shrink and a misregistration may arise when the secondary transfer roller 35 or the belt cleaner 33 abuts on or moves cleared off the intermediate transfer belt 31 before primary transfer completes, registration control for correcting the timing of starting image forming is performed in some cases. When such registration control is performed, during the operation described with FIGS. 9 and 10, the timing of abutting of the abutting member and the timing of clearing off of the abutting member always remain unchanged, and hence, an amount of timing correction for registration control always stays at a constant value, whereby registration control is prevented from becoming complicated.

In addition, in the preferred embodiment shown in FIGS. 9 and 10, when one wishes to form only one image of a size which can be transferred two images to the intermediate transfer belt 31 while the intermediate transfer belt 31 rotates one round and the transfer paper 4 is the thick paper described above, as for each one of the transfer paper sizes, the toner image transfer start position on the downstream side is set such that the rear edge (the rear edge on the upstream side) of a toner image along the direction of rotational driving 72 will match with the rear edge on the upstream side of the transfer area 76 within the intermediate transfer belt 31, but the size of the image is not limiting. For instance, even when image forming of a size which can be transferred only one image to the intermediate transfer belt 31 while the intermediate transfer belt 31 rotates one round, in the event that the transfer paper 4 is the thick paper mentioned above, the toner image transfer start position on the downstream side may be set such that the rear edge (the rear edge on the upstream side) of a toner image along the direction of rotational driving 72 will match with the upstream side rear edge of the transfer area 76 within the intermediate transfer belt 31.

In this modified embodiment, in a low speed mode, the CPU 111 controls forming an electrostatic latent image so that the rear edge of a toner image will match with the upstream side edge of the transfer area 76 along the direction of rotational driving 72.

Figure 11A:
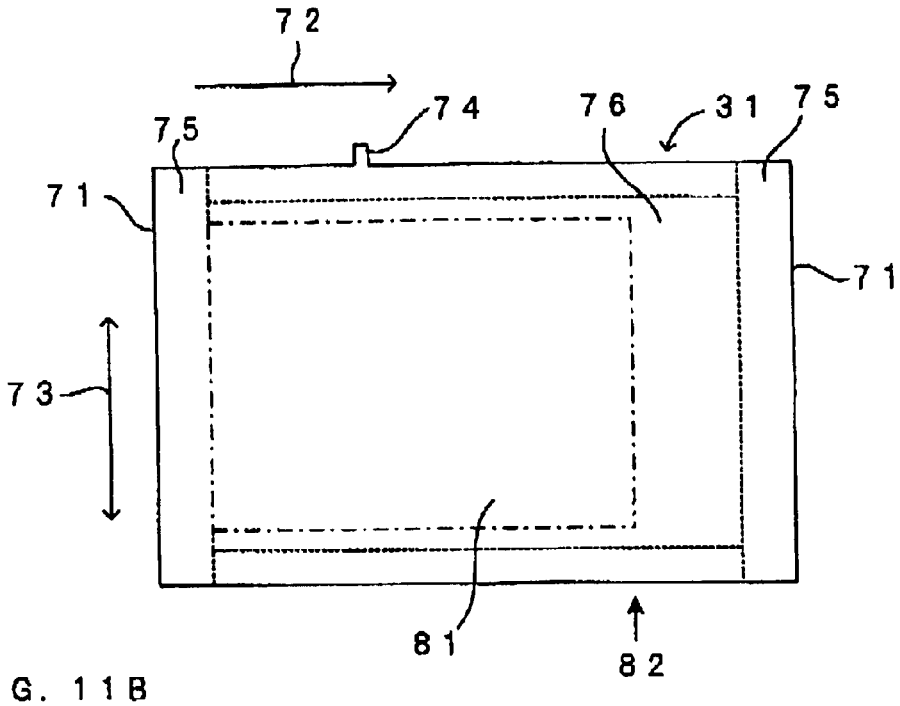
FIGS. 11A and 11B are drawings for describing the image transfer position relative to the intermediate transfer belt in a modified embodiment.
Figure 11B:
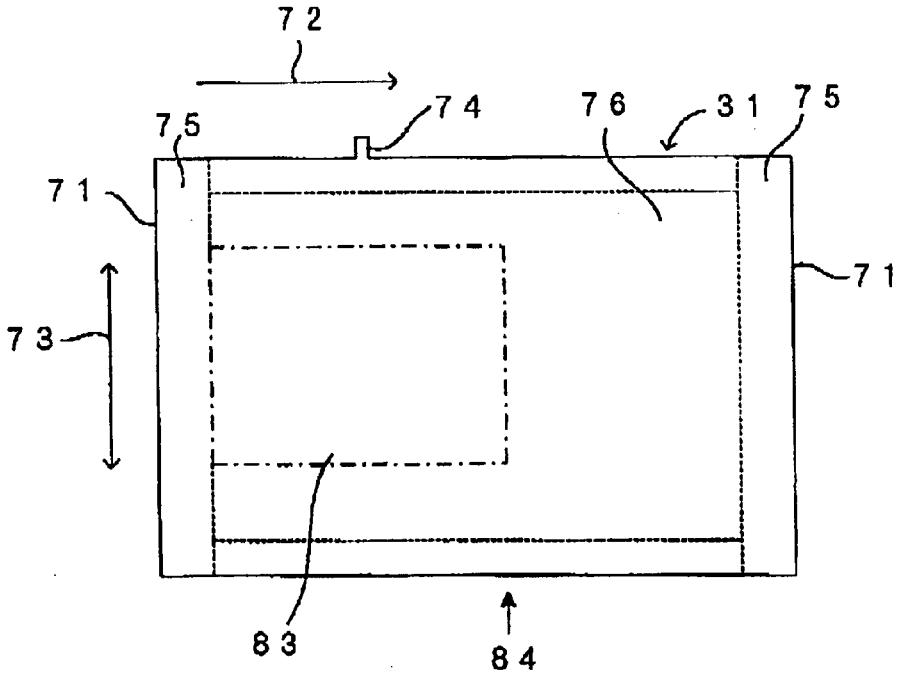

During this operation, for instance, a toner image transfer start position 82 is set such that the upstream side edge of a toner image 81 having the A3 size will match with the upstream side edge of the transfer area 76 as shown in FIG. 11A, and a toner image transfer start position 84 is set such that the upstream side edge of a toner image 83 having the A4 size will match with the upstream side edge of the transfer area 76 as shown in FIG. 11B.

Hence, an elapsed time until outputting of the video request signal Vreq since the vertical synchronizing signal Vsync is determined in advance for each one of the transfer paper sizes. In other words, the elapsed time until outputting of the video request signal Vreq since the vertical synchronizing signal Vsync is determined in advance so that transfer of a toner image will start at the toner image transfer start positions 82 and 84 for example. Thus determined elapsed time is stored as the control program in the ROM 112.

According to the modified embodiment shown in FIGS. 11A and 11B, in the low speed mode, the rear edge (the rear edge on the upstream side) of a toner image along the direction of rotational driving 72 always matches with the upstream side edge of the transfer area 76, and hence, the operations to start next image forming, such as the operation of starting deceleration of the intermediate transfer belt 31 in synchronization to turning off of the developing bias, the operation of contacting and clearing the secondary transfer roller 35 and the operation of contacting and clearing the belt cleaner 33, are timed to be always the same regardless of the transfer paper size, the number of images formed while the intermediate transfer belt 31 rotates one round, etc. This prevents control parameter settings from becoming complex and the design of the control program from becoming complex.

Further, according to the modified embodiment shown in FIGS. 11A and 11B, in the low speed mode, the rear edge of a toner image along the direction of rotational driving 72 always matches with the upstream-most side of the transfer area 76, it is possible to minimize a deterioration in throughput. In addition, the timing of abutting of the abutting member and the timing of clearing off of the abutting member always stay unchanged during registration control described above, and hence, an amount of timing correction for registration control always stays at a constant value, whereby registration control is prevented from becoming complicated.

Still further, according to the preferred embodiment, there are the two sub areas 76A and 76B of the transfer area 76 to serve as toner transfer areas, lined up from the downstream side to the upstream side along the direction of rotational driving 72, within the intermediate transfer belt 31, and each one of the sub areas 76A and 76B has such a size which permits to transfer of an A4-size or smaller image. However, the size of the intermediate transfer belt 31 is not limited to this. Instead, in the intermediate transfer belt 31, there may be N pieces of toner transfer areas for example, i.e., the first through the N-th (where N is an integer which is equal to or larger than 2) toner transfer areas, corresponding to a predetermined transfer paper size such as the B5 size arranged one next to the other from the downstream side to the upstream side along the direction of rotational driving 72. In short, in the preferred embodiment, the sub area 76A corresponds to the first toner transfer area and the sub area 76B corresponds to the N-th, namely, the second toner transfer area.

Further, the foregoing has described the preferred embodiment, while referring to FIGS. 6 through 8, in relation to an example that one wishes to form only one image of a size which can be transferred two images to the intermediate transfer belt 31 while the intermediate transfer belt 31 rotates one round, this is not limiting. In a configuration for example wherein there are the first through the N-th N pieces of sub areas for instance (where N is an integer which is equal to or larger than 3), each as a toner transfer area which corresponds to a predetermined transfer paper size, arranged one next to the other from the downstream side to the upstream side along the direction of rotational driving 72, when an image forming condition is to transfer M pieces of toner images (where M is an integer which is equal to or larger than 1 but smaller than N) having the predetermined transfer paper size mentioned above, forming an electrostatic latent image on the photosensitive member 11 may be controlled so that toner images will be primarily transferred onto those transfer areas among the N pieces of toner transfer areas other than at least the first transfer area (which corresponds to the sub area 76A in the preferred embodiment). In a configuration wherein toner images are primarily transferred onto M pieces of toner transfer areas which are the N-th and the subsequent toner transfer areas toward the downstream side along the direction of rotational driving 72, it is possible to minimize a deterioration in throughput.

In addition, when the image forming condition is as described above, as forming an electrostatic latent image on the photosensitive member 11 is controlled so that the rear edge of the M-th toner image will match with the upstream side edge of the N-th toner image transfer area along the direction of rotational driving 72, it is possible to control the operations during and after primary transfer always at the same timing regardless of the size of a transfer paper.

The present invention is not limited to the preferred embodiment described above. The preferred embodiment described above may be modified in various manners to the extent not deviating from the object of the invention.

For instance, although the preferred embodiment described above uses the intermediate transfer belt 31 which is formed by an endless belt joined at the splice 71, the intermediate transfer medium of the present invention is not limited to this. Instead, the intermediate transfer medium may be an intermediate transfer belt formed by a seamless endless belt having no splice, or an intermediate transfer drum which has a cylindrical shape.

Further, although the preferred embodiment described above requires that the belt cleaner 33 and the secondary transfer roller 35 abut on or move cleared off the intermediate transfer belt 31 when primary transfer of a toner image onto the intermediate transfer belt 31 from the photosensitive member 11 is not ongoing, this is not limiting. For instance, abutting and clearing off may be performed after a predetermined period since the time at which forming (development of) a toner image on the photosensitive member 11 ends.

Further, while the foregoing has described the preferred embodiment above in relation to a printer which prints on a transfer paper an image supplied from an external apparatus such as a host computer; the present invention is not limited to this. The present invention is applicable to general image forming apparatuses technique utilizing electrophotography including copier machines, facsimile machines, etc.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising: developing means which makes toner adhere to an electrostatic latent image formed on a photosensitive member to thereby form a toner image; an intermediate transfer medium onto which said toner image is primarily transferred during rotations of said intermediate transfer medium; secondary transfer means which secondarily transfers said toner image thus primarily transferred and now on said intermediate transfer medium onto a transfer paper; and fixing means which fixes said toner image on said transfer paper while said transfer paper is transported, wherein said image forming apparatus comprises transportation control means which has a normal mode for transporting a transfer paper at a first speed and a low speed mode for transporting a transfer paper at a second speed which is slower than said first speed at least from a secondary transfer position to a fixing end position, said image forming apparatus comprises intermediate transfer medium control means which drives said intermediate transfer medium at said first speed in said normal mode, but drives said intermediate transfer medium at said first speed in said low speed mode at least until the end of forming a toner image performed by said developing means, reduces a driving speed of driving said intermediate transfer medium from first speed to said second speed after the end of forming said toner image and then maintains said second speed at least until the end of secondary transfer, said image forming apparatus comprises image form control means which controls image forming on said photosensitive member so as to change a primary transfer start position on said intermediate transfer medium in accordance with a transfer paper size, said intermediate transfer medium has a transfer area, in which primary transfer of a toner image is possible and which is preset from the downstream side toward the upstream side along a direction of rotational driving, and said image form control means, in said low speed mode, controls said image forming so that a toner image will be primarily transferred onto such a portion of said transfer area which is on the upstream side of said intermediate transfer medium along a direction of rotational driving.

2. The image forming apparatus of claim 1, wherein said intermediate transfer medium further has a transfer protection area in which primary transfer of a toner image is prohibited and which is along a direction of rotation axis, and said image form control means, in said low speed mode, controls said image forming so that a toner image will be primarily transferred onto such a portion of said transfer area which is close to said transfer protection area and on the upstream side of said intermediate transfer medium along a direction of rotational driving.

3. The image forming apparatus of claim 2, wherein in said low speed mode, said image form control means controls said image forming so that the rear edge of a toner image primarily transferred onto said intermediate transfer medium will always stay at the same position.

4. The image forming apparatus of claim 3, wherein in said low speed mode, said image form control means controls said image forming so that the rear edge of a toner image primarily transferred onto said intermediate transfer medium will match with the upstream edge of said transfer area along the direction of rotational driving.

5. The image forming apparatus of claim 3, further comprising an abutting member which is switched between an abutting position and a cleared-off position relative to said intermediate transfer medium, and abutting member control means which makes said abutting member abut on said intermediate transfer medium or move cleared off from said intermediate transfer medium after a set period of time determined in advance from the end of forming a toner image on said photosensitive member.

6. The image forming apparatus of claim 5, wherein said abutting member control means makes said abutting member abut on said intermediate transfer medium or move cleared off from said intermediate transfer medium, when primary transfer of a toner image onto said intermediate transfer medium from said photosensitive member is not ongoing.

7. The image forming apparatus of claim 5, wherein said abutting member is a cleaning member which removes, at the abutting position on said intermediate transfer medium, toner which remains on said intermediate transfer medium.

8. The image forming apparatus of claim 1, wherein in said intermediate transfer medium, there are the first through the N-th N pieces of toner transfer areas (where N is an integer which is equal to or larger than 2) corresponding to a predetermined transfer paper size arranged one next to the other from the downstream side toward the upstream side along a direction of rotational driving, and in said low speed mode and when an image forming condition is to transfer M pieces of toner images (where M is an integer which is equal to or larger than 1 but smaller than N) having said predetermined transfer paper size, said image form control means controls said image forming so that said toner images will be primarily transferred onto those transfer areas among said N pieces of toner transfer areas other than at least said first transfer area.

9. The image forming apparatus of claim 8, wherein under said image forming condition, said image form control means controls said image forming so that said toner images will be primarily transferred onto, among said N pieces of toner transfer areas, M pieces of transfer areas which are said N-th and subsequent transfer areas toward the downstream side along the direction of rotational driving.

10. The image forming apparatus of claim 9, wherein under said image forming condition, said image form control means controls said image forming so that the rear edge of said M-th toner image will match with the upstream edge of said N-th transfer area along the direction of rotational driving.

11. The image forming apparatus of claim 10, further comprising an abutting member which is switched between an abutting position and a cleared-off position relative to said intermediate transfer medium, and abutting member control means which makes said abutting member abut on said intermediate transfer medium or move cleared off from said intermediate transfer medium after a set period of time determined in advance from the end of forming a toner image on said photosensitive member.

12. The image forming apparatus of claim 11, wherein said abutting member control means makes said abutting member abut on said intermediate transfer medium or move cleared off from said intermediate transfer medium, when primary transfer of a toner image onto said intermediate transfer medium from said photosensitive member is not ongoing.

13. The image forming apparatus of claim 11, wherein said abutting member is a cleaning member which removes, at the abutting position on said intermediate transfer medium, toner which remains on said intermediate transfer medium.

14. An image forming method in which a toner image, which is formed as toner adheres to an electrostatic latent image formed on a photosensitive member, is primarily transferred onto an intermediate transfer medium, thus primarily transferred toner image is thereafter secondarily transferred onto a transfer paper and said toner image is fixed on said transfer paper while said transfer paper is transported, wherein said method comprises:

a normal mode for transporting a transfer paper at a first speed and a low speed mode for transporting a transfer paper at a second speed which is slower than said first speed at least from a secondary transfer position to a fixing end position;

an intermediate transfer medium controlling step of driving said intermediate Safer medium at said first speed in said normal mode, but driving said intermediate transfer medium at said first speed in said low speed mode at least until the end of forming a toner image, reducing a driving speed of driving said intermediate transfer medium from first speed to said second speed after the end of forming said toner image and then maintaining said second speed at least until the end of secondary transfer;

an image form controlling step of controlling image forming on said photosensitive member so as to change a primary transfer start position on said intermediate transfer medium in accordance with a transfer paper size, said intermediate transfer medium has a transfer area, in which primary transfer of a toner image is possible and which is preset from the downstream side toward the upstream side along a direction of rotational driving, and at said image form controlling step, in said low speed mode, said image forming is controlled so that a toner image will be primarily transferred onto such a portion of said transfer area which is on the upstream side along a direction of rotational driving of said intermediate transfer medium.

15. The image forming method of claim 14, wherein said intermediate transfer medium further has a transfer protection area in which primary transfer of a toner image is prohibited and which is along a direction of rotation axis, and at said image form controlling step, in said low speed mode, said image forming is controlled so that a toner image will be primarily transferred onto such a portion of said transfer area which is close to said transfer protection area and on the upstream side along a direction of rotational driving of said intermediate transfer medium.

16. The image forming method of claim 14, wherein in said intermediate transfer medium, there are the first through the N-th N pieces of toner transfer areas (where N is an integer which is equal to or larger than 2) corresponding to a predetermined transfer paper size arranged one next to the other from the downstream side toward the upstream side along a direction of rotational driving, and at said image form controlling step, in said low speed mode and when an image forming condition is to transfer M pieces of toner images (where M is an integer which is equal to or larger than 1 but smaller than N) having said predetermined transfer paper size, said image forming is controlled so that said toner images will be primarily transferred onto those transfer areas among said N pieces of toner transfer areas other than at least said first transfer area.

* * * * *